United States Patent [19]

Reale

[11] 4,250,017

[45] Feb. 10, 1981

[54] PROCESS AND APPARATUS FOR SEPARATING TAR FROM A TAR SAND MIXTURE

[76] Inventor: Lucio V. Reale, 1827 - 46 St. SE., Calgary, Alberta T2B 2J9, Canada

[21] Appl. No.: 84,063

[22] Filed: Oct. 12, 1979

Related U.S. Application Data

[63] Continuation-in-part of Ser. No. 959,594, Nov. 13, 1977, abandoned.

[30] Foreign Application Priority Data

Dec. 12, 1977 [CA] Canada ..... 272879

[51] Int. Cl.[3] ..... B01D 12/00; C10G 1/04

[52] U.S. Cl. ..... 208/11 LE; 196/155; 208/11 R; 210/511; 210/800

[58] Field of Search ..... 196/155; 208/11 R, 11 LE

[56] References Cited

U.S. PATENT DOCUMENTS

| | | | |
|---|---|---|---|
| 1,615,121 | 1/1927 | Fyleman | 208/11 LE |
| 3,159,562 | 12/1964 | Bichard et al. | 208/11 LE |
| 3,208,930 | 9/1965 | Andrassy | 208/11 LE |
| 3,751,358 | 8/1973 | Elliott | 208/11 LE |
| 3,891,550 | 6/1975 | Gray et al. | 208/11 R |
| 3,993,555 | 11/1976 | Park et al. | 208/11 LE |
| 4,017,377 | 4/1977 | Fairbanks et al. | 208/11 LE |
| 4,018,682 | 4/1977 | Boyer | 208/11 LE |
| 4,029,568 | 6/1977 | Pittman et al. | 208/11 LE |

FOREIGN PATENT DOCUMENTS

| | | | |
|---|---|---|---|
| 787898 | 6/1968 | Canada | 208/11 LE |

*Primary Examiner*—Herbert Levine

*Attorney, Agent, or Firm*—Larson, Taylor and Hinds

[57] ABSTRACT

A process and apparatus for separating tar from a tar sand mixture. The separating step is by a novel mechanical process avoiding the complication of heating, freezing and the use of solvents. In the process a suitable suspension liquid is added to a tar sand mixture which is then struck with a plurality of striker arms to separate tar from sand particles and agglomerate tar into droplets. After the striking step, the sand particles are allowed to settle to the bottom and tar droplets rise and float, the tar droplets are skimmed off the mixture, and the tar droplets are also scraped off the striker arms. The resulting tar droplets are washed at least once to remove remaining sand particles.

32 Claims, 5 Drawing Figures

PROCESS AND APPARATUS FOR SEPARATING TAR FROM A TAR SAND MIXTURE

REFERENCE TO RELATED APPLICATION

This application is a continuation-in-part of my earlier copending application Ser. No. 959,594, filed Nov. 13, 1977, now abandoned.

BACKGROUND OF THE INVENTION

The present invention relates to a system and processes concerned with the separation of tar from sand and tar shale.

Tar sand deposits exist in many places throughout the world. Perhaps the largest tar sand deposit is in Athabasca, Northern Alberta. For the last twenty years or more, attempts have been made to separate the tar or bitumen deposits from the sand. None of these have proved economically feasible because of the costs that are involved in the different processes. The type of processes attempted include heating the tar sand mixture, freezing the mixture, and adding solvents to the tar sand mixture. All attempts have generally involved the introduction of more energy than is feasible or economical to separate the tar from the sand. In some cases, tar is found in rock shale formations and it is first necessary to crush the rock before any attempts to separate the tar from the shale. Throughout this specification the term tar sand includes crushed tar shale.

Another type of process that has been attempted is the mechanical separation of tar and sand. One example of the mechanical separation process has been illustrated in U.S. Pat. No. 3,891,550 which issued on June 24, 1975 to Gray et al. This process involved compressing or compacting tar sand against a rotating oleophilic surface so as to form a layer on that surface. Then under the influence of the attraction of tar to the oleophilic surface and centrifugal forces, the sand separates from the tar and is dislodged from the surface, leaving the tar to be scraped off the surface.

Tar sand is generally found with each particle of sand having a coating of tar and water surrounding it. The problem is to remove this coating of tar and water and then separate the tar from the water. If it was merely a question of just removing the tar from the sand this would be a great deal simpler, however, the tar and water separating from the sand also retains a small quantity of clay and it is this combination of tar, water and clay which is hard to separate.

SUMMARY OF THE INVENTION

I have found, surprisingly, that I can separate tar from tar sands and tar shales by a mechanical process different from that disclosed in U.S. Pat. No. 3,891,550 which avoids all the complications and expense of chemical solvents, heating, cooling, and the like. This simple mechanical process breaks down the layer of tar surrounding the particles of sand which is not always achieved in the process and apparatus disclosed in U.S. Pat. No. 3,891,550 and also breaks down the tar-water relationship so that the clay and water present in the tar sand may be washed away by a simple washing step. By striking or pounding a mixture of tar sand in suspension with a series of violent strokes, I find that the tar tends to break away from the particle of sand and regroups in tar droplets. These tar droplets then agglomerate together to form larger tar droplets. The sand particles now separated from their tar layers are heavier and sink to the bottom of the mixture is suspension and the tar droplets float up to the top of the mixture. After the series of violent strokes, some of the tar has stuck to the striking arms and may be scraped off. The tar sand mixture is then left to settle, and it is found that a tar layer floats to the top of the mixture, which may be skimmed off. The bottom layer of the mixture is almost all sand, but there is a layer on top of this sand layer which is a mixture of tar and sand. This tar sand layer may be discarded, further processed or recycled through the striking step again. The tar skimmed off the top of the mixture and scraped off the striking arms is carefully washed to remove any particles of sand that may stick to the surface of the tar droplets.

The present invention provides a process for separating tar from a tar sand mixture comprising the steps of adding a suitable suspension liquid to a tar sand mixture, striking the tar sand mixture with a plurality of striker arms to separate tar from sand particles and agglomerate tar into droplets, ceasing striking and allowing the sand particles to settle and tar droplets to rise and float, skimming the floating tar droplets, scraping tar droplets from the plurality of striker arms, and washing tar droplets removed by skimming and scraping at least once to remove further sand particles. In a preferred embodiment the preferred suspension liquid is water. The plurality of striker arms may either rotate about an axis or reciprocate within a vessel. In yet another embodiment the sand particles and remainder of the tar sand mixture are removed after the striking step and subjected to a frictional compression to separate tar from sand particles and agglomerate tar into droplets. The frictional compression of this last embodiment is preferably carried out between two moving belts.

The present invention also provides an apparatus for separating tar from a tar sand mixture comprising a vessel, a plurality of striker arms mounted for movement within the vessel and having a surface for droplets of tar to adhere thereto, means for moving the plurality of striker arms to produce a series of violent strokes within the vessel adapted to separate tar from sand particles and agglomerate tar into droplets, skimming means adapted to skim tar droplets floating on the tar sand mixture and a suspension liquid, drain means adapted to drain the vessel and remove sand particles and any remaining tar sand mixture, and scraper means movably positioned adapted to scrape the tar droplets off the plurality of striker arms after the series of violent strokes.

The present invention further relates to a process for separating tar from a tar sand mixture comprising the steps of, adding a suitable suspension liquid to a tar sand mixture, striking the tar sand mixture with a plurality of striker arms in a plurality of striking steps to separate tar from sand particles and agglomerate tar into droplets; providing movement between the plurality of striker arms and the tar sand mixture between one or more striking steps such that the plurality of striker arms strike a fresh area of the tar sand mixture in suspension; allowing the sand particles to settle and tar droplets to rise and float between the one or more striking step; skimming the floating tar droplets between the one or more striking step; scraping the tar droplets from the plurality of striker arms between the one or more striking step, and; washing tar droplets recovered by skimming and scraping at least once to remove further sand particles.

BRIEF DESCRIPTION OF THE DRAWINGS

The invention will now be described by way of example and reference being had to the accompanying drawings in which.

DESCRIPTION OF THE PREFERRED EMBODIMENTS

Before commencing the process of the present invention, it is necessary to clean the tar sand mixture. Furthermore, it is preferable that the sand be approximately the same size. Thus, if one is starting with a tar shale mixture wherein the shale is in the form of large pieces of rock, then it is preferable to crush the rock before proceeding with the extracting process. If the mixture is a dirty mixture, that is to say, if it has other minerals or other materials mixed in, then a first step is to wash the tar sand mixture before commencing the extraction process. Tar sand mixtures have varying quantities of tar associated with the sand particles. The tar content is dependent upon sand particle size, thickness of tary layer, water content and a number of other variables. The tar envelopes each particle of sand and forms a layer around it, and the problem is to remove this layer of tar and separate it from the sand particle.

Figure 1:
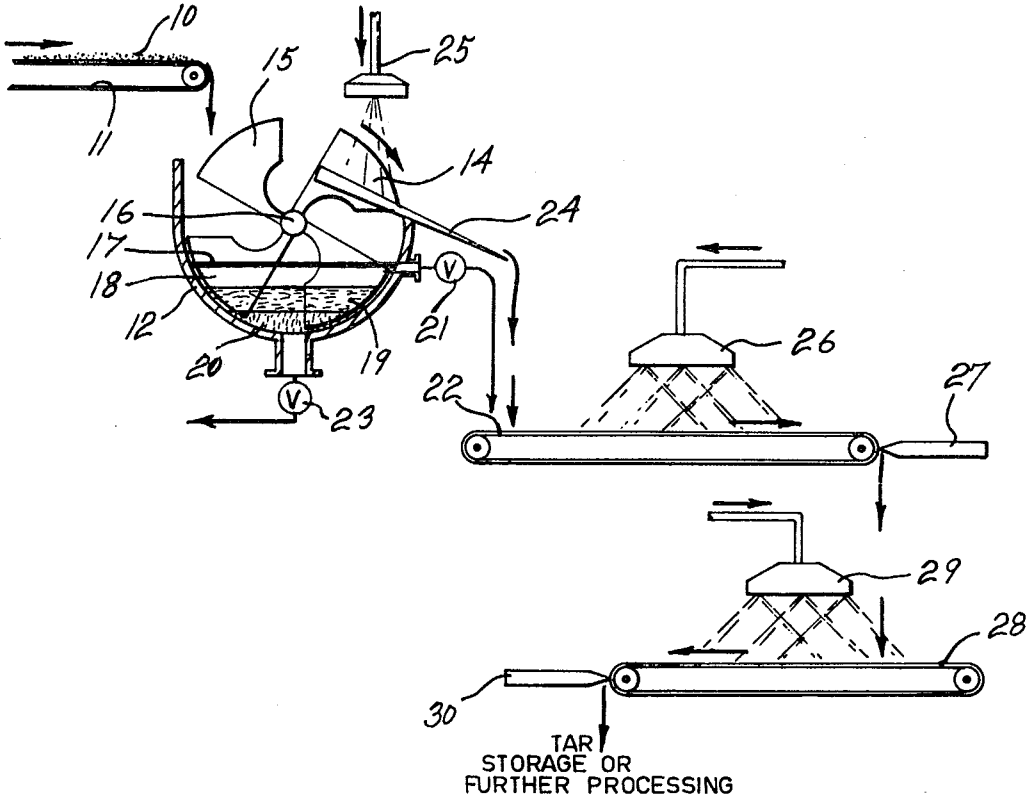
FIG. 1 is one example of a layout of one embodiment of the process of the present invention.

As shown in FIG. 1 a clean tar sand mixture 10 is introduced by a conveyor belt 11 into a separator vessel 12 and a suitable suspension liquid is added. This suspension liquid is preferably water, but brine may be used or other liquids that do not freeze at low temperatures. The vessel 12 has a semi-cylindrical shape with a horizontal axis and is formed of steel. The inside surface may be resilient and have a wood or rubber layer therein. In another embodiment the vessel may be constructed entirely of wood formed like a barrel with wooden staves. At the bottom of the vessel is a drain 23 which may be opened from time to time to drain out sand and remaining tar sand mixture. A striker 14 comprises a plurality of rotating striker arms 15 mounted on a shaft 16 which is supported on bearings at each end mounted on the sides of the separator vessel 12. The shaft 16 is driven at a sufficient speed so that the arms 15 strike the mixture 10 within the vessel with a series of violent strokes. This striking action breaks up and separates the coatings of tar surrounding the sand particles. These separated coatings of tar regroup into droplets which in turn agglomerate into larger tar droplets. These droplets of tar are highly viscous or sticky and have an affinity to stick together or in some cases adhere to the striking surfaces on the arms 15 of the striker 14. The striking surface on the arms 15 is preferably formed from a resilient material such as wood, rubber or plastic to allow the tar droplets to adhere or stick thereto. In another embodiment the arms 15 are made from steel but have a liner on their striking surface made from resilient material.

After the striker arms 15 have completed their series of violent strokes, the rotation of the striker 14 is stopped or slowed right down, and the tar-sand mixture and liquid is left for a sufficient time for the sand particles to sink to the bottom and for the tar droplets to float to the top. It has been found that after being allowed to stand for a while the tar sand mixture and liquid form a series of layers. The top layer 17 is tar droplets which are substantially free from sand particles, under the floating layer is a layer 18 of the suspension liquid and then an intermediate layer 19 which comprises some tar-sand mixture which has missed being struck by the striker arms, and some sand particles which still have some portion of the coating of tar adhering thereto. Under this intermediate layer 19 is a sand layer 20 which has substantially no droplets of tar adhering thereto.

The top tar layer 17 is skimmed off the top and passed through a valved outlet 21 and onto a conveyor 22. The skimming step merely requires ensuring the tar layer 17 is initially above the outlet 21. After skimming the top layer 17, a drain valve 23 is opened and the sand layer 20 is washed out followed by the intermediate layer 19 and the liquid layer 18. The intermediate layer 19 may be thrown out, recycled back into the separator vessel 12 or processed by other means. Next a moving scraper 24 is moved so that it is in contact with the striking surfaces of the striker arms 15, and the striker 14 is rotated so the tar droplets adhering to the striking surfaces are removed. The tar droplets are sprayed with wash water from a shower 25 to remove any loose sand particles or mineral particles that can be washed off and are then deposited onto the conveyor 22 with the other tar droplets skimmed off the top layer 17. The conveyor 22 passes under a washer 26 where wash water is sprayed onto the tar resting thereon. Throughout this specification the washing medium has been referred to as wash water, however, it will be appreciated that other washing solutions or mixtures may be used. Furthermore, the conveyor 22 may be a belt or screw conveyor or any of a number of available types of conveyors which agitate or shake the tar as it passes under the washer to allow maximum surface exposure of the tar to the wash water. The wash water removes most of the remaining loose sand or mineral particles, it also washes away any clay or silt from the original tar sand mixture. A scraper 27 at the end of the conveyor 22 scrapes the tar off the conveyor 22 and drops it onto a second conveyor 28 which passes under another washer 29 which again washes the tar which is then scraped off the conveyor 28 by a further scraper 30. Further washing steps may follow if required, and the tar is then placed in tanks or drums for storage or continues for further processing.

Figure 2:
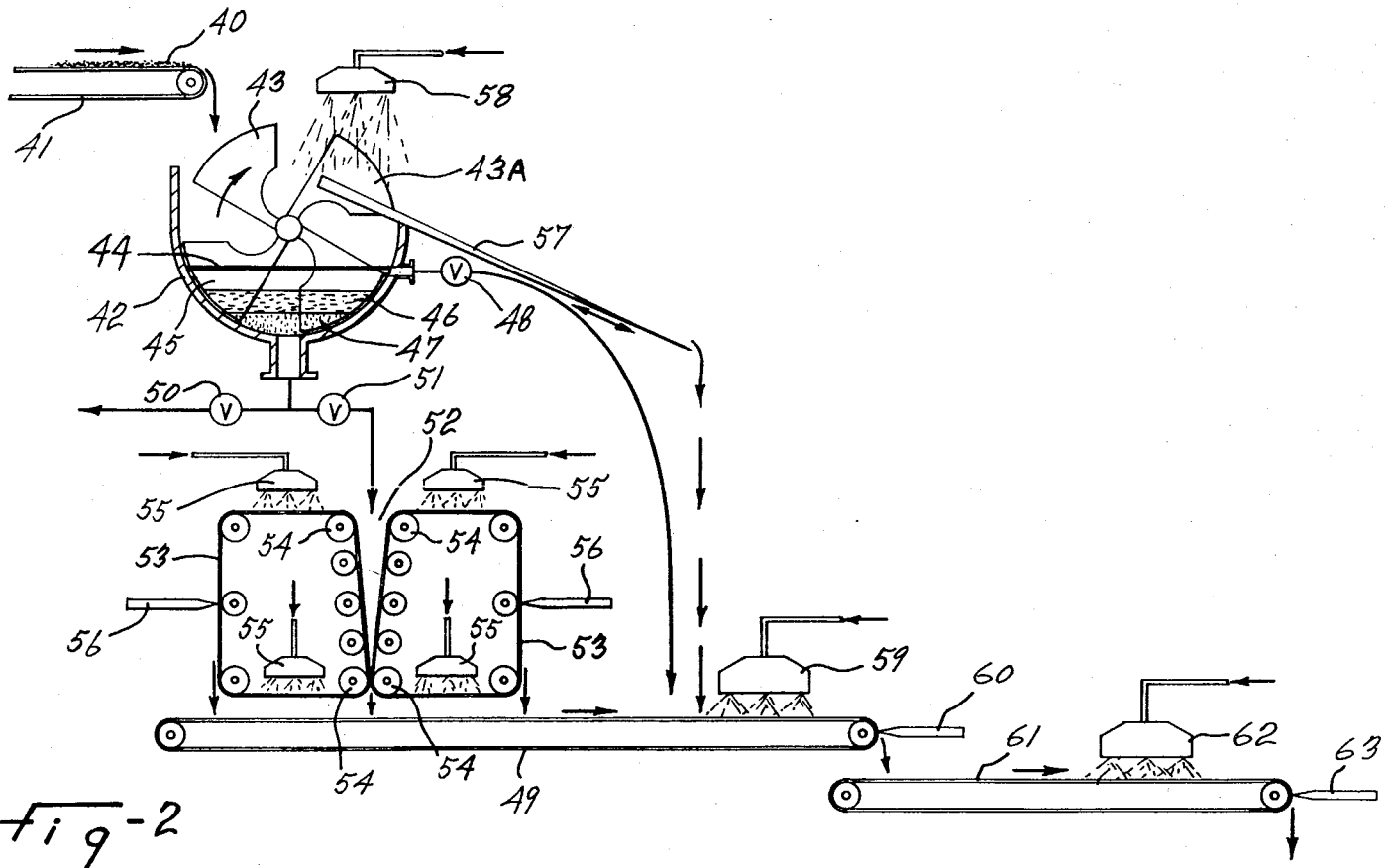
FIG. 2 is another example of a layout of an embodiment of the process of the present invention.

The process shown in FIG. 2 illustrates another embodiment wherein two stages are used to extract tar from the tar sand mixture. Referring to FIG. 2, a tar sand mixture 40 on a conveyor 41 is fed into a separator vessel 42 of the type shown in FIG. 1. A striker 43 formed of a plurality of rotating striking arms **43*a* pound or strike the tar sand mixture and suspension liquid with a series of violent strokes produced by the rotating action of the striker. After the striking step, the mixture is allowed to stand so that a floating or top layer 44 of tar droplets forms with a liquid layer 45 underneath above an intermediate layer 46 of sand having some tar therein and a bottom sand layer 47. In the manner previously described the top layer 44 of tar is skimmed off the top through a valve outlet 48 and deposited on a conveyor 49. A first drain valve 50 is then opened and the bottom layer 47** of sand is allowed to flow out.

When the sand layer 47 has been removed, the first drain valve 50 is closed and a second drain valve 51 is opened so that the intermediate layer 46 of tar and sand is fed into the nip 52 between two belts 53 running between supporting rolls 54. The tar and sand in the nip 52 is subjected to a frictional compression between the belts 53 which are either going at different speeds or directions. The nip 52 is adjustable by the supporting rolls 54 being mounted for movement but always being pressured together. Guide means (not shown) prevent spillage of the tar and sand from the sides of the nip 52. This action separates the tar and sand and causes the tar to agglomerate into tar droplets. Some of the tar droplets are deposited on the conveyor 49 below the nip, the remainder of the tar droplets adhere to the surfaces of the belts 53. The belts 53 pass under showers 55 and after washing the tar is scraped off the belts by scrapers 56, and dropped onto the conveyor 49.

After the vessel 42 has been drained, a scraper 57 is pushed into contact with the striking surface of the striking arms 43*a* and the tar droplets scraped off the striker 43, washed under a shower 58 and deposited onto the conveyor 49. The tar droplets then proceed on the conveyor belt 49 under a washer 59 to remove most of the remaining loose sand and silt, and is scraped off by a scraper 60 which deposits the tar onto a second conveyor 61. The second conveyor 61 again passes the tar under another washer 62 and the tar is eventually scraped off the conveyor 61 by a scraper 63 and passed for storage or further processing.

Figure 3:
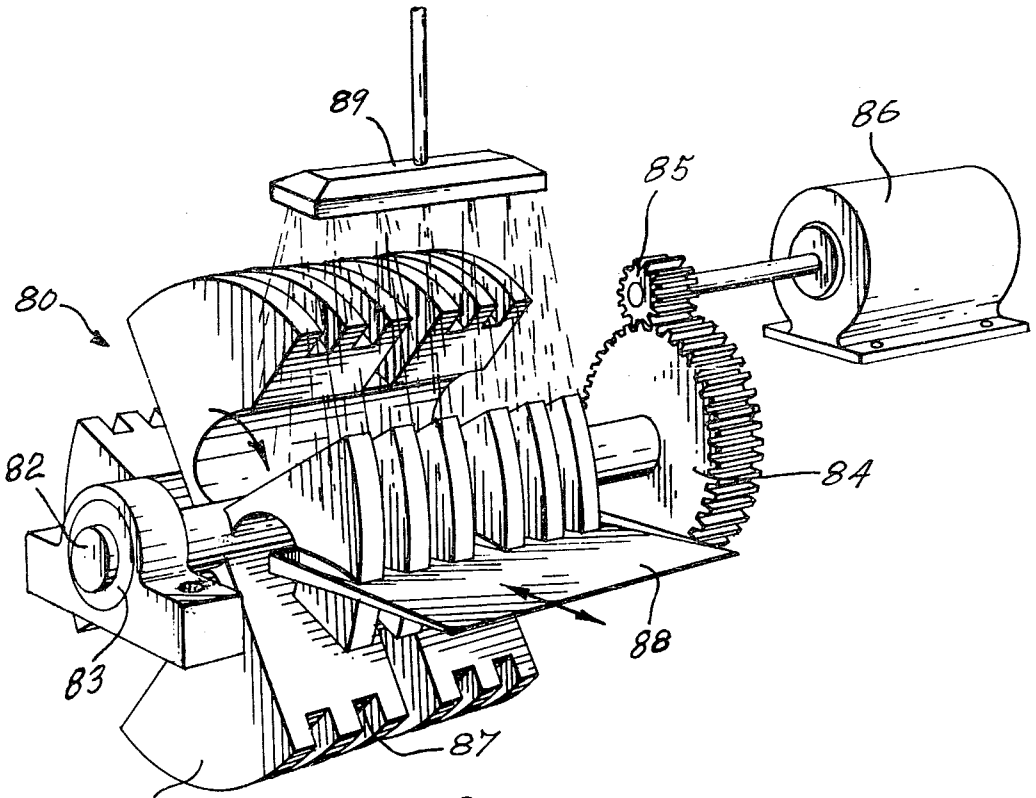
FIG. 3 is an isometric view of an apparatus according to one embodiment of the present invention.

A striker 80 of the type shown in FIGS. 1 and 2 is illustrated in FIG. 3. The striker 80 has a plurality of striker arms 81, four arms in the embodiment shown, connected to a shaft 82. The shaft 82 has bearings 83 at each end and is driven by a gear 84 and pinion 85 connected to an electric variable speed motor 86.

It will be apparent to those skilled in the art that although one drive arrangement is illustrated here, other types of drive systems such as chain or belt drives may be used, and other types of prime moves such as internal combustion engines, hydraulic or air motors may be employed to rotate the striker 80. The speed of rotation is such that the violent strokes of the arms 81 is sufficient to separate the coatings of tar from the sand particles. The rotating arms 81 have a plurality of indentations 87 on the outside surface to increase the surface area to which tar droplets can adhere. Whereas the striking surface of each arm is shown as perpendicular to the direction of rotation, this surface may be at an angle so that the striking impact is spread out over the rotation of the striker 80 and a more even force occurs on the rotating shaft 82. A slower speed is preferable for scraping the tar droplets off the striking surface. This slower speed may be obtained either my means of a variable speed or two speed motor, by changeable gearing or by a separate motor geared down to rotate the stricker 80 at the desired speed. A scraping device 80 slides from an engaged position to a disengaged position. When engaged the device 88 fits the exact contour of the arms 81 including the indentations 87. The scraping device 88 has wedge shaped surfaces pressing against the arms 81 to remove and retain the tar droplets and direct them to a conveyor. A shower 89 sprays water on the arms 81 and the scraping device 88 to wash the tar droplets and aid in moving them down the scraping device 88.

In one embodiment the striker 80 may be used without a separator vessel by being placed directly in the tar sand deposit field. It is preferred to place the striker in a hollow to which water may be added. After the striking action, the tar droplets may then be skimmed off the water surface. A mobile striker enables the first separation step to be carried out in the field and subsequent washing and processing steps may then be carried out at a plant site. In severe winter, liquids having low freezing points may be used to prevent the tar sand mixture from freezing. Also heaters may be employed to keep the tar droplets at a temperature where the oil is sufficiently viscous to agglomerate into larger droplets.

In another embodiment heat may be incorporated in the arms 81 of the separator 80 so that the tar droplets are maintained at the best viscosity to stick to the surfaces of the arms.

Figure 4:
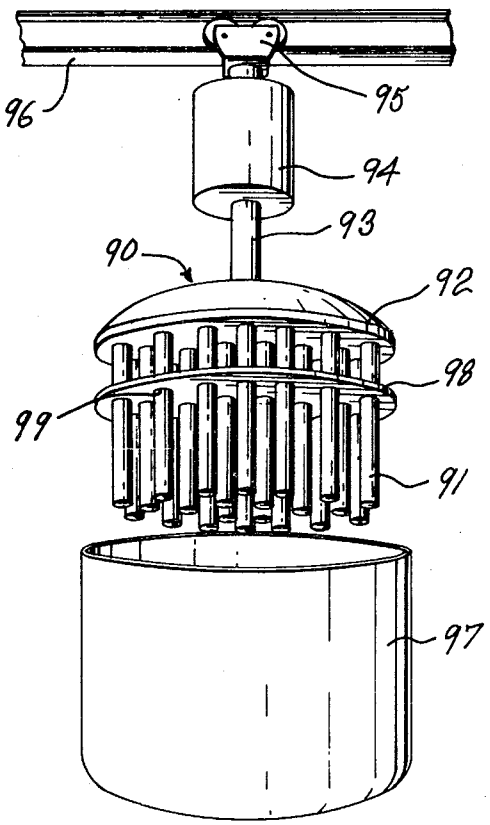
FIG. 4 shown on the first sheet of drawings is an isometric view of an apparatus according to another embodiment of the present invention.

Another type of striker 90 is shown in FIG. 4 which comprises a plurality of vertical slender striker arms 91 preferably formed from a resilient material or having an outer coating of resilient material such as rubber, plastic or wood. The resilient material allows and assists in the adhering of the agglomerated tar droplets to the arms 91. The arms 91 are all attached at their uppermost ends to a horizontal head plate 92. The head plate 92 supports the arms 91 in their vertical position and holds them rigidly in that position during the striking step. The head plate 92 is attached to a piston arm 93 of a hydraulic cylinder 94. The hydraulic cylinder is supported from an overhead trolley 95 running on an I-beam 96. They hydraulic cylinder 94 is adapted to lower the arms 91 into a separator vessel 97 and reciprocates the arms 91 up and down within the vessle 97 thus producing a series of violent blows upon the tar sand mixture and liquid within the vessel 97. The trolley 95 allows the striker 90 to move to another position so the arms 91 may be lowered into a washing tank (not shown). A scraper device comprises a plate 98 having a series of holes 99 therein which exactly fit over the arms 91. During the striking step, the scraper plate 98 rests against the head plate 92 of the striker arms 91 and then during the scraping step this scraper plate 98 is moved downwards removing all the tar deposits that are adhering to the arms 91. In this manner, the arms 91 are cleaned and the tar removed therefrom.

When a separator vessel such as shown in FIG. 1 or 2 is used, the process is generally a batch process and the tar sand mixture is fed into the vessel in batches and the desired amount of liquid added. After the striking step, and the scraping step, the vessel is washed out before another batch of tar sand mixture is fed in. The desired amount of liquid is sufficient to allow a top layer of tar droplets to float on a layer of liquid when the batch has stood for a predetermined time after the striking step.

The washing steps as shown in the drawings, are either by dipping in wash water or by a shower means as in the preferred embodiment, however, as will be understood the steps are interchangeable. The wash water is preferably at ambient temperatures, provided that the temperature is sufficiently high to keep the tar sufficiently viscous to allow the sand particles to be washed off the outside of the tar droplets.

In the operation of the separator vessel, it is found that from time to time tar droplets adhere to the sides of the vessel, thus, it is necessary to scrape the vessel at regular intervals to remove the tar droplets adhering thereto. The tar droplets scraped from the inside of the vessel may be washed and then placed on the conveyor which rewashes the tar before passing it to storage or further processing.

The friction belts as shown in FIG. 2 are preferably formed from stainless steel, rubber, plastics or any other suitable material that can be bent provided the surface is suitable for the tar droplets to adhere to. In the case of a steel belt, a resilient coating is preferred to aid in the adhesion of the tar particles. Furthermore, the wedges or scrapers used to remove the tar droplets from the belts or the conveyors, are also preferably formed from a resilient material.

On the completion of the extracting process, the tar which is in a highly viscous form may be stored in barrels, drums, tanks or the like. Alternatively, it may pass immediately for further processing such as refining. It has been found that if additional time is spent in the separating process more of the sand is removed from the tar sand mixture. Further refining steps may be used with the tar product resulting from the separating process which include separating steps using solvents, by a freezing process or other extracting processes to remove the final sand or silt particles within the tar.

Figure 5:
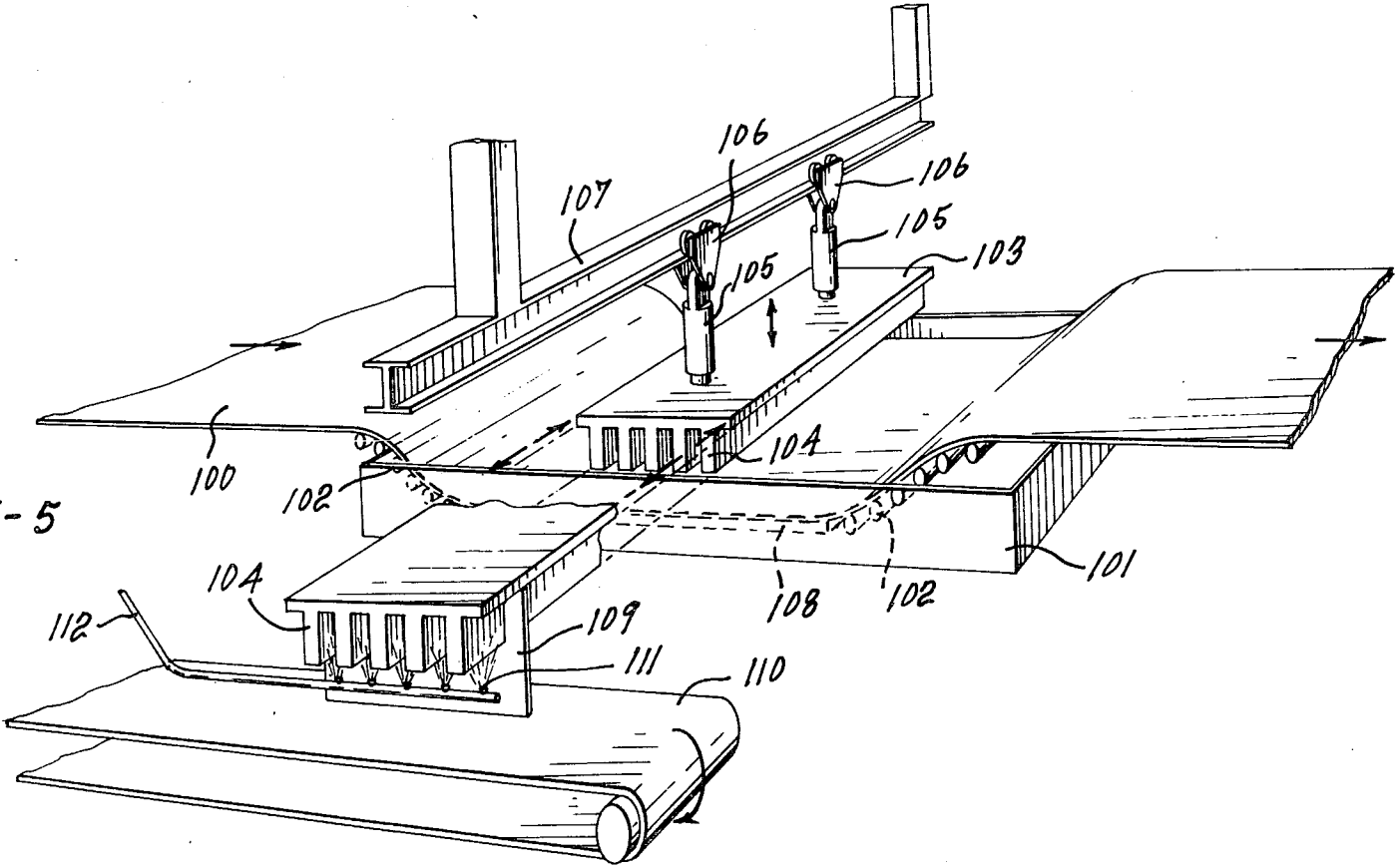
FIG. 5 is an isometric view of an apparatus according to yet a further embodiment of the present invention.

In a further embodiment of the present invention, with particular reference to FIG. 5, separation of the tar from a tar sand mixture can be achieved by a continuous process.

The previous embodiments shown in the specification have been primarily concerned with different types of batch processes wherein tar sand mixture in suspension is placed within a vessel, a plurality of striker arms then strike the tar sand and the tar droplets are formed which tend to stick to the striker arms. After the striking action the remaining tar sand and sand in suspension within the vessel is removed, the tar is scraped off the striker arms and a new batch of tar sand is placed within the vessel. It has now been found that this process may be employed on a continuous basis. FIG. 5 illustrates an apparatus suitable for such continuous operation. The tar sand in a clean condition is placed upon a conveyor belt 100 which dips down into a vessel or trough 101 with the conveyor belt 100 being supported on rollers 102. A suitable suspension liquid, preferably water, is in the vessel 101 and the tar sand mixture on the belt 100 passes beneath a striker 103. The striker 103 has a plurality of striker blades 104 and the striker unit 103 is supported by two pneumatic cylinders 105 each hanging from an I-beam trolley 106 which runs on an I-beam 107 transverse to the direction of motion of the conveyor belt 100. The striker 103 reciprocates vertically upwards and downwards, and on the downstroke the striker blades 104 strike the tar sand mixture on the conveyor belt 100. In the area beneath the striker 103 the belt 100 rests on a plate 108 so that the striking action is conveyed through the belt 100 to the plate 108 and does not damage the belt itself. The downward action of the striker 103 causes the blades 104 to penetrate and compact the tar sand mixture directly beneath the blades. This action causes the coating of tar surrounding each sand particle to break down and separate into droplets. These tar droplets regroup into larger droplets of tar and are highly viscous or sticky. The tar droplets have an affinity to stick together and they also stick to the striker blades 104 of the striker 103. In a preferred embodiment the sides of these striker blades are coated with a sticky coating to aid in collecting the tar droplets. During the striking action it is preferable that the conveyor belt 100 is stationary. One or in some cases more than one stroke occurs with the striker striking the one area of the tar sand mixture. The striker then stays in the upper position, and is conveyed along the rail 107 to a scraping position. As shown in FIG. 3 a scraper 109 passes between the blades 104 and scrapes the tar adhering thereto dropping the tar onto a conveyor 110. Water sprays 111 are provided from a water supply line 112 to aid in removal of the tar particles from the striker blades 104.

In operation, the striker 103, is reciprocated upwards and downwards by the pneumatic cylinders 105 with the conveyor belt 100 stationary. After one stroke or in some cases more than one stroke the striker is moved acress to the scraping position, where the scraper 109 scrapes the tar off the striker blades 104 dropping it onto a conveyor belt 110 and the tar is conveyed away for further processing as shown in FIGS. 1 and 2. During the time that the striker 103 is being scraped the conveyor belt 100 moves forward one increment or step. This increment is preferably the thickness of each striker blade 104 so that the next time the striker is used on the tar sand mixture it strikes a fresh area of tar sand which has not been struck before. Thus, there is a synchronous movement with the striker 103 striking downwards when the belt 100 is stationary and the belt 100 moving forward in increments when the striker 103 is in the top position or just before it moves downwards.

As in the previous illustrations some tar droplets float to the top of the trough 101 and a skimmer (not shown) is provided to skim these floating tar droplets off the suspension liquid. These tar droplets are then passed for further processing as shown in FIGS. 1 and 2. The clean sand remains on the conveyor 100 and exits off the end of the conveyor.

In a preferred embodiment the blades 104 of the striker 103 are coated with a sticky substances that has an affinity to oil, such a coating is sticky and may be an asphalt derivative to which the tar adheres to in the striking step. When the tar is scraped off the blades 104 is a film of tar over this sticky coating may remain on the blades.

It will be apparent to those skilled in the art that this striker system may be operated without a conveyor belt, in fact the striker itself may be the unit that moves horizontally along a layer or trough of tar sand mixture in a liquid suspension. In this manner a continuous process is obtained rather than a batch process.

Whereas the striker system described and illustrated in FIG. 5 shows a reciprocating action, a rotating type striker may be utilized similar to that shown in FIG. 3. The rotation of the striker arms is synchronized with horizontal movement between the striker arms and the tar sand so the striker arms strike an unstruck area of tar sand between one or more striker actions.

I claim:

1. A process for separating tar from a tar sand mixture comprising the steps of, adding a suitable suspension liquid to a tar sand mixture, striking the tar sand mixture with a plurality of striker arms to separate tar from sand particles and agglomerate tar into droplets, ceasing striking and allowing the sand particles to settle and tar droplets to rise and float, skimming the floating tar droplets, scraping the tar droplets from the plurality of striker arms, and, washing tar droplets recovered by skimming and scraping at least once to remove further sand particles.

2. The process according to claim 1 wherein the suitable suspension liquid is water.

3. The process according to claim 2 wherein the water is at ambient temperature.

4. The process according to claim 1 wherein the process occurs in a tar sand deposit field.

5. The process according to claim 4 wherein the suspension liquid has a low freezing point.

6. The process according to claim 1 wherein the plurality of striker arms rotate about an axis.

7. The process according to claim 1 wherein the plurality of striker arms reciprocate within a vessel.

8. The process according to claim 1 wherein the tar sand mixture is a tar shale mixture including crushing the shale before adding a suitable liquid.

9. The process according to claim 1 including the initial step of washing the tar sand mixture before the striking step.

10. The process according to claim 7 wherein the washing step includes dipping the plurality of striker arms having tar droplets adhering thereto into wash water.

11. The process according to claim 1 wherein the washing step includes spraying wash water onto the plurality of striker arms having tar droplets adhering thereto.

12. The process according to claim 1, wherein the washing step includes agitating the tar droplets and simulataneously spraying the droplets with water.

13. A process for separating tar from a tar sand mixture comprising the steps of, adding water to a batch of tar sand mixture within a vessel, striking the tar sand mixture with a plurality of striker arms to separate tar from sand particles and agglomerate tar into droplets, ceasing striking and allowing the sand particles to settle and tar droplets to float, skimming the floating tar droplets, scraping the tar droplets from the striker arms, removing sand particles and remainder of the tar sand mixture from the vessel, subjecting the remainder to a frictional compression to separate tar from sand particles and agglomerate tar into droplets, and washing tar droplets recovered from skimming, scraping, and frictional compression at least once to remove further sand particles.

14. The process according to claim 13 wherein the frictional compression is performed between two moving belts mounted on variable support means and providing a nip there between, the nip having guide means adapted to prevent spillage at either side of the nip, and scraping tar droplets off the belts.

15. The process according to claim 14 wherein the belts move at different speeds.

16. The process according to claim 14 wherein the belts move in different directions.

17. The process according to claim 13 or claim 16 wherein the belts are subjected to a washing step by being sprayed before the tar droplets are scraped off the belts.

18. An apparatus for separating tar from a tar sand mixture comprising, a vessel, a plurality of striker arms mounted for movement within the vessel and having a surface for droplets of tar to adhere thereto, means for moving the plurality of striker arms to produce a series of violent strokes within the vessel adapted to separate tar from sand particles and agglomerate tar into droplets, skimming means adapted to skim tar droplets floating on the tar sand mixture and a suspension liquid, drain means adapted to drain the vessel and remove sand particles and any remaining tar sand mixture, and scraper means movably positioned adapted to scrape the tar droplets off the plurality of striker arms after the series of violent strokes.

19. The apparatus according to claim 18 including a washing means adapted to wash the plurality of striker arms after the series of violent strokes and before scraping the tar droplets off the plurality of striker arms.

20. The apparatus according to claim 18 wherein the plurality of striker arms are mounted on a central shaft supported in bearings mounted at sides of the vessel and means for moving the plurality of striker arms includes rotational drive means having a first speed adapted to produce the series of violent strokes and a second speed suitable for scraping the plurality of striker arms.

21. The apparatus according to claim 18 wherein the plurality of striker arms are mounted for reciprocal movement within the vessel and means for moving the plurality of striker arms includes reciprocating drive means.

22. The apparatus according to claim 21 including a washing means comprising a separate vessel containing water and a shaking means for shaking the plurality of striker arms within the separate vessel before scraping the tar droplets off the plurality of striker arms.

23. The apparatus according to claim 18, wherein the striker arms are lined with resilient material.

24. The apparatus according to claim 18 wherein the striker arms are formed of resilient material.

25. The apparatus according to claim 18 wherein the vessel is lined with resilient material.

26. The apparatus according to claim 18 wherein the plurality of striker arms having heating means therein.

27. A process for separating tar from a tar sand mixture comprising the steps of, adding a suitable suspension liquid to a tar sand mixture, striking the tar sand mixture with a plurality of striker arms in a plurality of striking steps to separate tar from sand particles and agglomerate tar into droplets;

providing movement between the plurality of striker arms and the tar sand mixture between one or more striking steps such that the plurality of striker arms strike a fresh area of the tar sand mixture in suspension;

allowing the sand particles to settle and tar droplets to rise and float between the one or more striking step;

skimming the floating tar droplets between the one or more striking step, scraping the tar droplets from the plurality of striker arms between the one or more striking step, and;

washing tar droplets recovered by skimming and scraping at least once to remove further sand particles.

28. The process according to claim 27 wherein the separating occurs continuously.

29. The process according to claim 27 wherein the plurality of striker arms reciprocate having an upstroke and a down stroke, the striking step occurring on the down stroke, and wherein the movement between the plurality of striker arms and the tar sand mixture is horizontal occurring before the plurality of striker arms commence the downstroke.

30. The apparatus according to claim 18 wherein the tar sand mixture is conveyed through the vessel on a conveying means and wherein the means for moving the plurality of striker arms reduces upstrokes and downstrokes, the downstrokes striking the tar sand mixture, including synchronization means between the upstrokes and downstrokes to move the tar sand mixture on the conveyor means beneath the plurality of striker arms.

31. The process according to claim 27 wherein the plurality of striker arms rotate, the striking step occurring on a downward rotation, and wherein the movement between the plurality of striker arms and the tar sand mixture is horizontal occurring before the plurality of striker arms commence the downward position.

32. The apparatus according to any of claims 18, 20 or 21 wherein the striker arms are coated with a sticky substance that has an affinity to oil.

* * * * *